US006132178A

United States Patent [19]

Carter

[11] Patent Number: 6,132,178

[45] Date of Patent: Oct. 17, 2000

[54] HAND HELD PUMP DEVICE

[76] Inventor: Lonnie G. Carter, Box 54, Stuart, Okla. 74570

[21] Appl. No.: 09/039,239

[22] Filed: Mar. 16, 1998

[51] Int. Cl.[7] ..... F04B 53/00

[52] U.S. Cl. ..... 417/234; 417/264

[58] Field of Search ..... 417/234, 264

[56] References Cited

U.S. PATENT DOCUMENTS

| | | | |
|---|---|---|---|
| 2,635,550 | 4/1953 | Granberg | 417/234 |
| 3,015,281 | 1/1962 | Umholtz | 417/234 |
| 4,286,675 | 9/1981 | Tuggle | 173/213 |
| 4,746,274 | 5/1988 | Kiyooka et al. | 417/234 |
| 5,044,469 | 9/1991 | Liu | 184/1.5 |
| 5,269,665 | 12/1993 | Sadler et al. | 417/363 |

*Primary Examiner*—Teresa Walberg
*Assistant Examiner*—Vinod D Patel

[57] ABSTRACT

The present invention relates to hand held pump device. Such pump device includes a small lightweight motor. This motor can be manipulated by way of a hand grip. This hand grip includes a throttle trigger secured at an inner portion of the grip. A pump, with an inlet and outlet, is interconnected to the motor via a powered drive shaft. A load bearing support is positioned about this pump and secured to the lower extent of the motor. The load bearing support enables the entire pump device to be rested upon a level surface.

1 Claim, 2 Drawing Sheets

HAND HELD PUMP DEVICE

BACKGROUND OF THE INVENTION

1. Field of the Invention

The present invention relates to a hand held pump and more particularly pertains to such a pump which includes a load bearing housing.

2. Description of the Prior Art

The use of portable pumps is known in the prior art. More specifically, such portable pumps are known to consist basically of familiar, expected and obvious structural configurations, notwithstanding the myriad of designs encompassed by the crowded prior art which have been developed for the fulfillment of countless objectives and requirements.

By way of example,

In this respect, the hand held pump of the present invention substantially departs from the conventional concepts and designs of the prior art, and in so doing provides an apparatus primarily developed for the purpose of enabling a user to easily carry and operate a water pump.

Therefore, it can be appreciated that there exists a continuing need for improvements in pump construction. In this regard, the present invention substantially fulfills this need.

SUMMARY OF THE INVENTION

In view of the foregoing disadvantages inherent in the known types of portable pumps now present in the prior art, the present invention provides a pump which is easily carried and operated. As such, the general purpose of the present invention, which will be described subsequently in greater detail, is to provide a pump which can be selectively carried via a grip, or rested upon a load bearing frame.

To attain this, the present invention essentially comprises a hand held pump device. Such pump device includes a small lightweight motor. This motor can be manipulated by way of a hand grip. This hand grip includes a throttle trigger secured at an inner portion of the grip. A pump, with an inlet and outlet, is interconnected to the motor via a powered drive shaft. A load bearing support is positioned about this pump and secured to the lower extent of the motor. The load bearing support enables the entire pump device to be rested upon a level surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a grip through which the entire pump device and be carried and operated.

It is another object of the present invention to provide a load bearing structure at the lower end of the pump for use in resting the pump upon a level surface.

It is a further object of the present invention to provide a pump which is powered by a light weight two cycle engine.

An even further object of the present invention is to light weight pump which is susceptible of a low cost of manufacture with regard to both materials and labor, and which accordingly is then susceptible of low prices of sale to the consuming public, thereby making such light weight hand held pump economically available to the buying public.

Still another object of the present invention is to create a pump which finds particular use in emptying pools and the like.

Lastly, it is an object of the present invention to provide a new and improved hand held pump device with an associated load bearing structure. The pump includes a two cycle air cooled engine. The engine has and upper extent and a lower extent. A drive shaft extends from the lower extent of the engine, and a fuel tank is secured at the upper extent of the engine. A passage serves to interconnect the fuel tank and engine. A tapered housing is formed at the lower extent of the engine. The tapered housing has first and second sides and with a pair of apertures formed within the first side of the housing, and a pair of apertures formed within the second side of the housing. A grip is included and has an upper portion secured proximate the fuel tank and a lower portion secured proximate the lower extent of the engine. The grip has an inner surface with a pivotal trigger secured thereto. This trigger controls the supply of fuel being delivered into the engine and thus the rotational speed of the drive shaft. An on/off switch is formed opposite the inner surface of the grip for use in selectively turning on and off the engine. A water pump is interconnected to the device and has an inlet, an outlet and a drive socket. The drive shaft of the engine is secured within the drive socket of the water pump. The drive shaft functions to supply rotational power to the water pump and thereby drive water from the inlet toward the outlet of the water pump. The water pump further includes a base plate with first and second apertures formed therein. A load bearing housing is formed about the pump, with the load bearing housing taking the form of first and second side metal brackets. Each of these metal brackets has an angled upper extent with a pair of apertures formed therein and a lower extent with an aperture formed therein. Each bracket is secured by a pair of fasteners which connect the upper extent of the bracket to one of the pair of apertures within the tapered housing, and a fastener connecting the lower extent of the bracket to one of the apertures within the base plate of the pump. With each bracket so secured the housing has a planar base and a pair of inwardly tapering sidewalls, the loading bearing housing is for use in resting the pump upon a surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
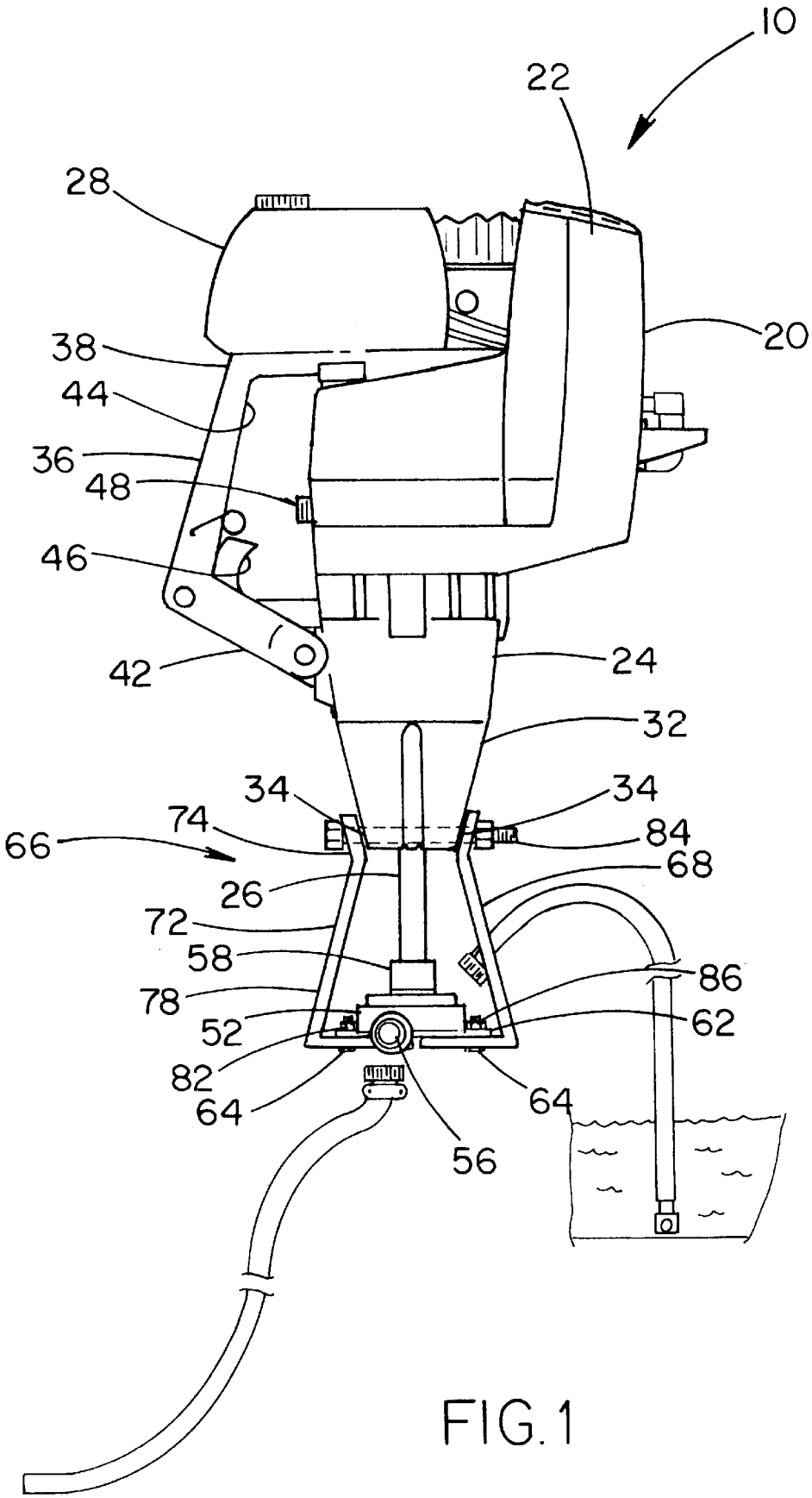
FIG. 1 is a elevational view of the pump device of the present invention.

With reference now to the drawings, and in particular to FIG. 1 thereof, the hand held pump device of the present invention is depicted. Such pump includes a small lightweight motor. This motor can be manipulated by way of a hand grip. This hand grip includes a throttle trigger secured at an inner portion of the grip. A pump, with an inlet and outlet, is interconnected to the motor via a powered drive shaft. A load bearing support is positioned about this pump and secured to the lower extent of the motor. The load bearing support enables the entire pump device to be rested upon a level surface. The various components of the present invention, and the manner in which they interrelate, will be described in greater detail hereinafter.

In the preferred embodiment, the pump device 10 is powered by a lightweight two cycle air cooled engine 20. Other lightweight engines, however, can be employed in conjunction with the present invention. The engine 20, as illustrated in FIG. 1, is defined by an upper extent 22 and a lower extent 24. Additionally, a drive shaft 26 extends from the lower extent 24 of the engine 20, and a fuel tank 28 is secured at the upper extent 22 of the engine 20. An internal passage serves to interconnect the fuel tank 28 and engine 20.

Figure 2:
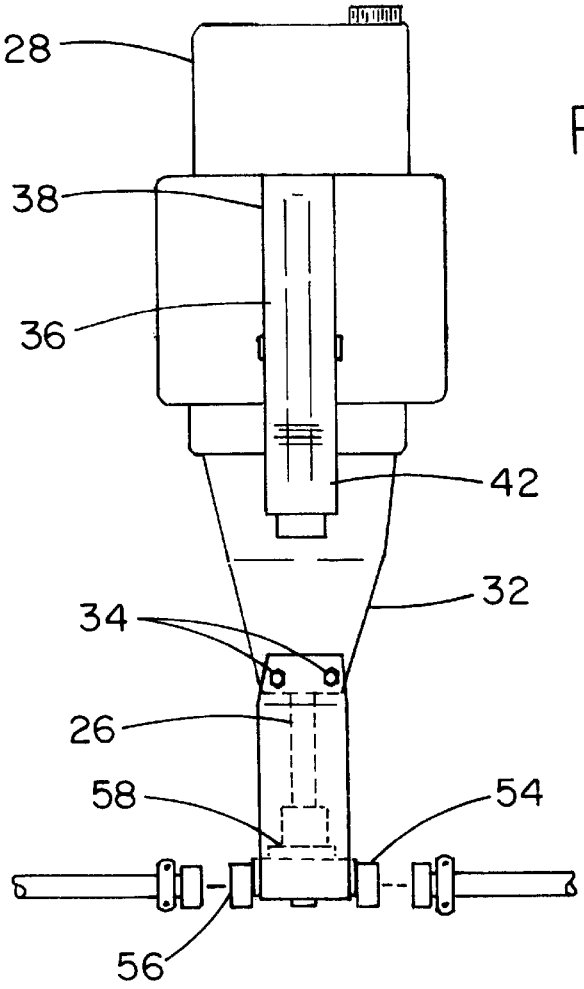
FIG. 2 is a side elevational view of the pump device.
Figure 3:
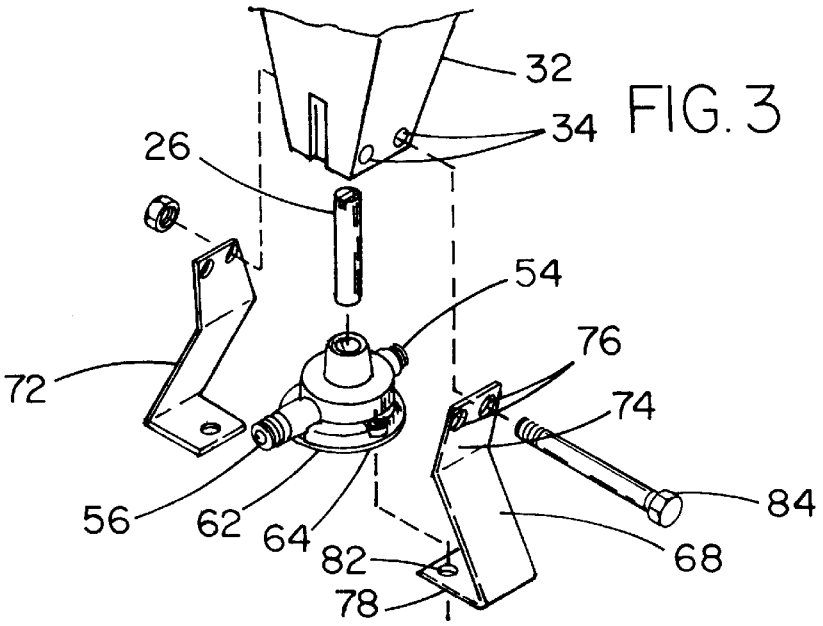

With reference now to FIGS. 2 and 3, the lower extent 24 of the motor/engine 20 is depicted. Such lower extent 24 is defined by a tapered housing 32. The tapered housing 32 includes first and second sides with a pair of apertures 34 formed within the first side, and a pair of apertures 34 formed within the second side. Such apertures 34 are for use in removably securing the loadbearing housing to the motor in a manner which will be described more fully hereinafter.

The entire motor assembly 20 can be manipulated via a grip 36. Such grip 36 has an upper portion 38 secured proximate the fuel tank 28,and a lower portion 42 secured proximate the lower extent 24 of the engine 20. The grip 36 includes an inner surface 44 with a pivotal trigger 46 secured thereto. This trigger 46 controls the supply of fuel being delivered into the engine 20, and thus the rotational speed of the drive shaft 26. Additionally, an on/off switch 48 is formed opposite the inner surface 44 of the grip 36. Such switch 48 is for use in selectively turning on and off the engine 20. Through the position of both the trigger 46 and on/off switch 48 the entire operation of the engine 20 can be controlled without the user taking their hand of the grip 36.

The engine 20 serves to supply rotational power to a fluid pump 52. In the preferred embodiment such fluid pump 52 is a Wayne pump model #wdp215. The fluid/water pump 52 is defined by an inlet 54, an outlet 56 and a drive socket 58. The drive shaft 26 of the engine 20 is secured within the drive socket 58 of the water pump 52. In this manner, the drive shaft 26 functions to supply rotational power to the water pump 52 and thereby drive water from the inlet 54 toward the outlet 56 of the water pump 52. The inlet 54 and outlet 56 are threaded such that they can each accept the threaded end of a length of hose. The water pump 52 is further defined by a base plate 62 with first and second apertures 64 formed therein. Such apertures are employed in securing the water pump 52 to the load bearing structure in a manner to be more fully described.

The loading bearing structure of the present invention is illustrated in FIG. 1. Such load bearing structure takes the form of a housing 66 which is positioned about the pump 52. With reference to FIG. 3, the load bearing housing 66 is made up of first and second side metal brackets (68 and 72 respectively). Each of these metal brackets is of an identical construction. Each metal bracket includes an angled upper extent 74, a planar lower extent and an angled intermediate extent therebetween. Additionally,each bracket has a pair of apertures 76 formed through its upper extent 74, and an aperture 82 formed within its lower extent. Each bracket is secured by a pair of fasteners 84 connecting the upper extent of each bracket to one of the pair of apertures 34 within the tapered housing 32. Likewise, a fastener 86 serves to connect the lower extent of the bracket to one of the apertures 64 within the base plate 62 of the pump 52. With each bracket so secured, the housing has a planar base and a pair of inwardly tapering sidewalls. The resulting loading bearing housing can be used in resting the pump upon a surface.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hand held pump device with an associated load bearing structure, the pump comprising, in combination:

a two cycle air cooled engine, the engine having an upper extent and a lower extent, a drive shaft extending from the lower extent of the engine, a fuel tank secured at the upper extent of the engine, a passage interconnecting the fuel tank and engine, tapered housing formed at the lower extent of the engine, the tapered housing having first and second sides and with a pair of apertures formed within the first side of the housing, and a pair of apertures formed within the second side of the housing;

a grip having an upper portion secured proximate the fuel tank and a lower portion secured proximate the lower extent of the engine, the grip having an inner surface with a pivotal trigger secured thereto, the trigger controlling the supply of fuel being delivered into the engine and thus the rotational speed of the drive shaft, an on/off switch formed opposite the inner surface of the grip for use in selectively turning on and off the engine;

a water pump having an inlet, an outlets and a drive socket, the drive shaft of the engine being secured within the drive socket of the water pump, the drive shaft functioning to supply rotational power to the water pump and thereby drive water from the inlet toward the outlet of the water pump, the water pump further including a base plate with first and second apertures formed therein;

a load bearing housing formed about the pump, the load bearing housing taking the form of first and second side metal brackets, each metal bracket having an angled upper extent with a pair of apertures formed therein and a planar lower extent formed with upper and lower surfaces and with an aperture formed therein, each bracket being secured by a pair of fasteners connecting the upper extent of the bracket to one of the pair of apertures within the tapered housing, and a fastener connecting the lower extent of the bracket to one of the apertures within the base plate of the pump with the base plate of the pump resting upon the upper surface of the lower extent of the side metal brackets and with each bracket so secured the housing having a planar base and a pair of inwardly tapering sidewalls, and with the lower surface of the lower extent of the side metal brackets being located beneath the base plate of the pump for use in resting the pump upon a surface.

* * * * *